US009702544B2

(12) United States Patent
Amoretti

(10) Patent No.: US 9,702,544 B2
(45) Date of Patent: Jul. 11, 2017

(54) BOILER FOR DOMESTIC APPLIANCES AND WATER HEATING SYSTEMS WITH STEAM PRODUCTION FOR HOME AND INDUSTRIAL USE

(71) Applicant: T.P.A. IMPEX S.P.A., Romano D'ezzelino (IT)

(72) Inventor: Luigi Amoretti, Romano D'Ezzelino (IT)

( * ) Notice: Subject to any disclaimer, the term of this patent is extended or adjusted under 35 U.S.C. 154(b) by 253 days.

(21) Appl. No.: 14/384,115

(22) PCT Filed: Mar. 12, 2013

(86) PCT No.: PCT/IB2013/051935
§ 371 (c)(1),
(2) Date: Sep. 9, 2014

(87) PCT Pub. No.: WO2013/136261
PCT Pub. Date: Sep. 19, 2013

(65) Prior Publication Data

US 2015/0063791 A1 Mar. 5, 2015

(30) Foreign Application Priority Data

Mar. 12, 2012 (IT) ..... MO2012A0061

(51) Int. Cl.
*A61M 16/00* (2006.01)
*F24F 3/14* (2006.01)
*F22B 1/28* (2006.01)

(52) U.S. Cl.
CPC ..... *F22B 1/28* (2013.01); *F22B 1/284* (2013.01)

(58) Field of Classification Search
None
See application file for complete search history.

(56) References Cited

U.S. PATENT DOCUMENTS

| | | | | |
|---|---|---|---|---|
| 1,874,244 A | | 8/1932 | Coates | |
| 2,627,015 A | | 1/1953 | Hackman | |
| 2,748,249 A | * | 5/1956 | Collerati | F24H 1/162 392/481 |
| 2,835,782 A | * | 5/1958 | Stiebel | A47J 31/106 392/451 |
| 2,870,318 A | * | 1/1959 | Karlen | F24H 1/202 219/429 |

(Continued)

FOREIGN PATENT DOCUMENTS

| | | |
|---|---|---|
| CH | 656202 | 6/1986 |
| NL | 9500322 | 10/1996 |

(Continued)

*Primary Examiner* — Thor Campbell
(74) *Attorney, Agent, or Firm* — Themis Law

(57) ABSTRACT

A boiler for domestic appliances and water heating systems with steam production for home and industrial use includes: a container body configured to contain a liquid to be heated and vaporized, and defining an inner containment chamber having a containment volume; a heating device having a radiant heating surface, the heating device including at least one pair of radiant elements having respective radiant surfaces accommodated in the containment chamber, in parallel and spaced relationship, and designed to be immersed in the liquid to cause a convective motion of the liquid between the radiant surfaces.

10 Claims, 10 Drawing Sheets

(56) References Cited

U.S. PATENT DOCUMENTS 2,903,551 A * 9/1959 Fischer ..... F24H 1/202 222/146.5
2,926,234 A * 2/1960 Palmer ..... A47J 31/54 126/351.1
3,381,110 A * 4/1968 Fischer ..... F24H 1/202 222/146.1
3,479,949 A * 11/1969 Reynolds ..... A47J 31/10 239/553.3
3,523,178 A * 8/1970 Drwal ..... A47J 31/56 392/451
3,559,427 A 2/1971 Baker
3,581,144 A * 5/1971 Beggs ..... H01J 1/22 219/467.1
3,617,700 A * 11/1971 Hooper ..... F24H 1/202 392/485
3,642,176 A * 2/1972 Dreibelbis ..... F24D 17/00 222/146.1
3,883,719 A * 5/1975 Hurko ..... H05B 3/748 219/452.12
3,969,605 A * 7/1976 Danell ..... F02N 19/10 123/142.5 E
4,139,762 A * 2/1979 Pohrer ..... F24F 6/18 126/113
4,263,498 A * 4/1981 Meyers ..... F24H 1/188 137/205.5
4,354,094 A * 10/1982 Massey ..... A47J 31/56 122/14.3
4,423,310 A * 12/1983 Zerbel ..... F22B 1/30 338/83
4,513,887 A * 4/1985 Wicke ..... F16B 7/0413 222/146.5
4,602,145 A * 7/1986 Roberts ..... A47J 31/007 219/513
4,641,011 A * 2/1987 Roberts ..... A47J 31/007 219/508
4,680,446 A * 7/1987 Post ..... F24D 17/00 122/13.3
4,697,735 A * 10/1987 Temple ..... F24F 6/00 236/44 C
4,730,099 A * 3/1988 Bleckman ..... H05B 3/82 219/437
4,835,366 A * 5/1989 Owen ..... H05B 3/80 119/73
4,906,817 A * 3/1990 Kurz ..... F24H 1/188 122/14.1
4,990,746 A * 2/1991 Hammond ..... F24H 1/188 222/108
4,992,644 A * 2/1991 Webb ..... A61L 2/04 219/440
5,063,609 A * 11/1991 Lorimer ..... F22B 1/28 257/E21.226
5,313,550 A * 5/1994 Crosnier ..... F24F 6/18 392/325
5,343,552 A * 8/1994 Peteri ..... E03C 1/0411 392/451
5,438,642 A * 8/1995 Posen ..... F24H 1/102 122/19.1
5,471,556 A * 11/1995 Friedheim ..... F22B 1/287 392/396
5,706,390 A * 1/1998 O'Neil ..... H05B 3/82 392/497
5,835,680 A * 11/1998 Glucksman ..... F24H 9/1818 338/315
5,881,207 A * 3/1999 DeBourg ..... F22B 1/285 340/618
5,923,819 A * 7/1999 Ross ..... B29C 65/561 122/19.2
5,949,958 A * 9/1999 Naperkowski ..... A61L 2/07 392/399
6,075,923 A * 6/2000 Wu ..... F24H 9/2021 392/451
6,094,524 A * 7/2000 Riley ..... F24H 1/188 392/441
6,148,144 A * 11/2000 Milanese ..... A47L 11/34 15/320
6,173,118 B1 * 1/2001 Harris ..... F24H 7/0433 126/344
6,198,879 B1 * 3/2001 Harris ..... F24H 7/0433 392/451
6,240,250 B1 * 5/2001 Blanco, Jr. ..... F24H 1/102 392/474
6,243,535 B1 * 6/2001 Bochud ..... F22B 1/285 392/447
6,477,323 B2 * 11/2002 Koizumi ..... F24H 9/1818 219/536
6,516,141 B1 * 2/2003 DeSantis ..... A47J 31/56 222/146.5
6,574,426 B1 * 6/2003 Blanco, Jr. ..... H05B 3/78 392/485
6,786,182 B2 * 9/2004 Morgandi ..... F22B 1/285 122/4 A
6,847,782 B1 * 1/2005 Kovacs ..... F24H 1/202 392/441
7,162,149 B2 * 1/2007 Evans ..... F22B 1/282 392/386
8,218,955 B2 * 7/2012 Witt ..... A47L 15/4285 392/441
8,515,268 B2 * 8/2013 Anliker ..... A47J 31/54 392/448
8,606,093 B2 * 12/2013 Montanaro ..... B23K 26/103 219/121.64
8,855,475 B2 * 10/2014 King ..... 392/441
2009/0047008 A1 * 2/2009 Straley ..... A01K 63/065 392/498
2009/0290858 A1 * 11/2009 Altman ..... A61H 33/065 392/485
2011/0095010 A1 * 4/2011 Bondarowicz ..... F24H 1/202 219/209
2015/0093101 A1 * 4/2015 Lee ..... A47C 21/048 392/450
2016/0178238 A1 * 6/2016 Chen ..... F24D 17/0078 137/337

FOREIGN PATENT DOCUMENTS

WO WO9721057 6/1997
WO WO2005058118 6/2005

* cited by examiner

BOILER FOR DOMESTIC APPLIANCES AND WATER HEATING SYSTEMS WITH STEAM PRODUCTION FOR HOME AND INDUSTRIAL USE

FIELD OF THE INVENTION

The invention relates to a boiler for domestic appliances and water heating systems with steam production for home and industrial use, which is generally intended for steam production in cleaning and disinfection appliances.

BACKGROUND ART

Domestic appliances have been long known and used, which are equipped with steam production devices emitting jets for cleaning and disinfecting wall or furniture surfaces.

Particularly, these domestic appliances comprise a boiler which is filled with water and in which an electric resistor is immersed, which resistor is supplied with power and heats up, thereby heating water by conduction to an evaporation or heating temperature with hot water production.

A volume of steam is generated in the boiler, at a pressure higher than atmospheric pressure, which is controlled by a pressure safety valve or a similar device, that switches off the electric resistor each time that pressure reaches a maximum preset limit value, thereby stopping water heating and steam production for as long as is required to restore normal pressure values in the boiler.

The boiler has a fluid-tight connection for a steam ejecting pipe leading to an outflow control valve or a similar device, which is in turn equipped with a connection for the end of a steam carrying hose, for carrying the steam to be ejected to the surfaces to be cleaned.

The cyclic steam jets from the hose are controlled by the control valve which is actuated to open or close by special manual controls which are generally located on a handle of the hose, to be easily actuated by the users as needed.

Typically, boilers adapted to be mounted to these domestic appliances are composed of a box-like body, or boiler body, which defines therein a heating chamber having a considerable volume, and able to contain a correspondingly considerable volume of water, whereas the electric resistor is supported in the heating chamber to be entirely or almost entirely immersed in this volume of water for heating it.

These resistors usually have a rectilinear and substantially elongate shape, to be almost entirely immersed in the volume of water to be heated while occupying as small a space as possible, such that the boilers also have small dimensions, and do not increase the overall size of the appliances in which they are placed.

This prior art suffers from certain drawbacks.

A first drawback is that, in prior art boilers, the ratio of the total length of the radiant surface of the resistors to the volume of water to be heated is disadvantageous and does not afford high efficiency.

A further drawback is that this kind of linear resistors have a limited length, whereby the power supply exceeds the limits of the resistor surface area, which involves a risk of melting or failure of the resistors.

Furthermore, no quick and substantially smooth steam production can be obtained, namely because the radiant surface of the heating resistors is very small as compared with the boiler size, whereby heating and steam production times are long and discontinuous.

Another drawback is that heat exchange between the radiant surfaces of the electric resistors and the water to be heated occurs by simple direct contact therebetween, and no particular arrangement is provided for enhancing the heating effect of resistors or, assuming a target heating temperature, for reducing the power supply required to attain a target temperature and cause boiler water to evaporate and produce steam.

A further drawback is that, when the pressure safety valve cuts off power to the electric resistor as a predetermined pressure limit is reached in the heating chamber of the boiler due to steam generation, a considerable amount of the steam so produced shall be emptied for the pressure safety valve to restore power to the resistor, and hence start a new water heating cycle.

This adversely affects the overall efficiency of the domestic appliances with steam production because, while the boiler is being emptied of the steam by ejection thereof, with the resistor being powered off, a volume of cold refilling water is automatically introduced into the boiler, such cold water mixing with the water therein that has been heated by a previous heating cycle and is still in the heating chamber.

Therefore, the overall water temperature is decreased and parts of the power supplied to the resistor for heating are cyclically lost, which will increase the temperature drop that will be covered by the resistor, by heating again the water in the heating chamber once the pressure safety valve restores power for a subsequent heating and steam production step.

Another drawback is that prior art boilers have a large size and require accordingly large housings in the domestic appliances, whose design is affected by this requirement, with designers being limited in their ability to provide domestic appliances with steam production having a more pleasant appearance, improved ergonomic features, a lighter weight and easier storage even in small spaces, when not in use.

DISCLOSURE OF THE INVENTION

One object of the invention is to improve the state of the art.

Another object of the invention is to obviate the above drawbacks, by providing a boiler for domestic appliances with steam production that has a higher efficiency than prior art boilers.

A further object of the invention is to considerably reduce both the boiler size and its water capacity, while maintaining a high and substantially consistent steam production.

Yet another object of the invention is to provide a boiler for domestic appliances with steam production that allows thermal interaction among multiple heating elements, to avoid the loss of parts of thermal energy supplied between successive steps of heating the water to be vaporized.

In one aspect, the invention relates to a boiler for domestic appliances and water heating systems with steam production for home and industrial use, as defined by the features of claim 1.

Particular embodiments of the invention are defined in the dependent claims.

The invention affords the following advantages:

- improving the overall efficiency of domestic appliances with steam production;
- disabling two or more heating elements and create a spontaneous flow of liquid to be heated therebetween, thereby reducing the temperature differences in the liquid to be heated and vaporized as it flows from one element to the other;

reducing the overall size of the boilers that are designed to be mounted to domestic appliances with steam production, which may have a lighter weight and a smaller size; and providing substantially ready-to-use volumes of steam, without requiring time-consuming liquid heating and vaporizing cycles.

BRIEF DESCRIPTION OF THE DRAWINGS

Further characteristics and advantages of the invention will be more apparent from the detailed description of a preferred, non-exclusive embodiment of a boiler for domestic appliances and water heating systems with steam production for home and industrial use, which is described as a non-limiting example with the help of the annexed drawings, in which.

DETAILED DESCRIPTION OF A PREFERRED EMBODIMENT

Figure 1:
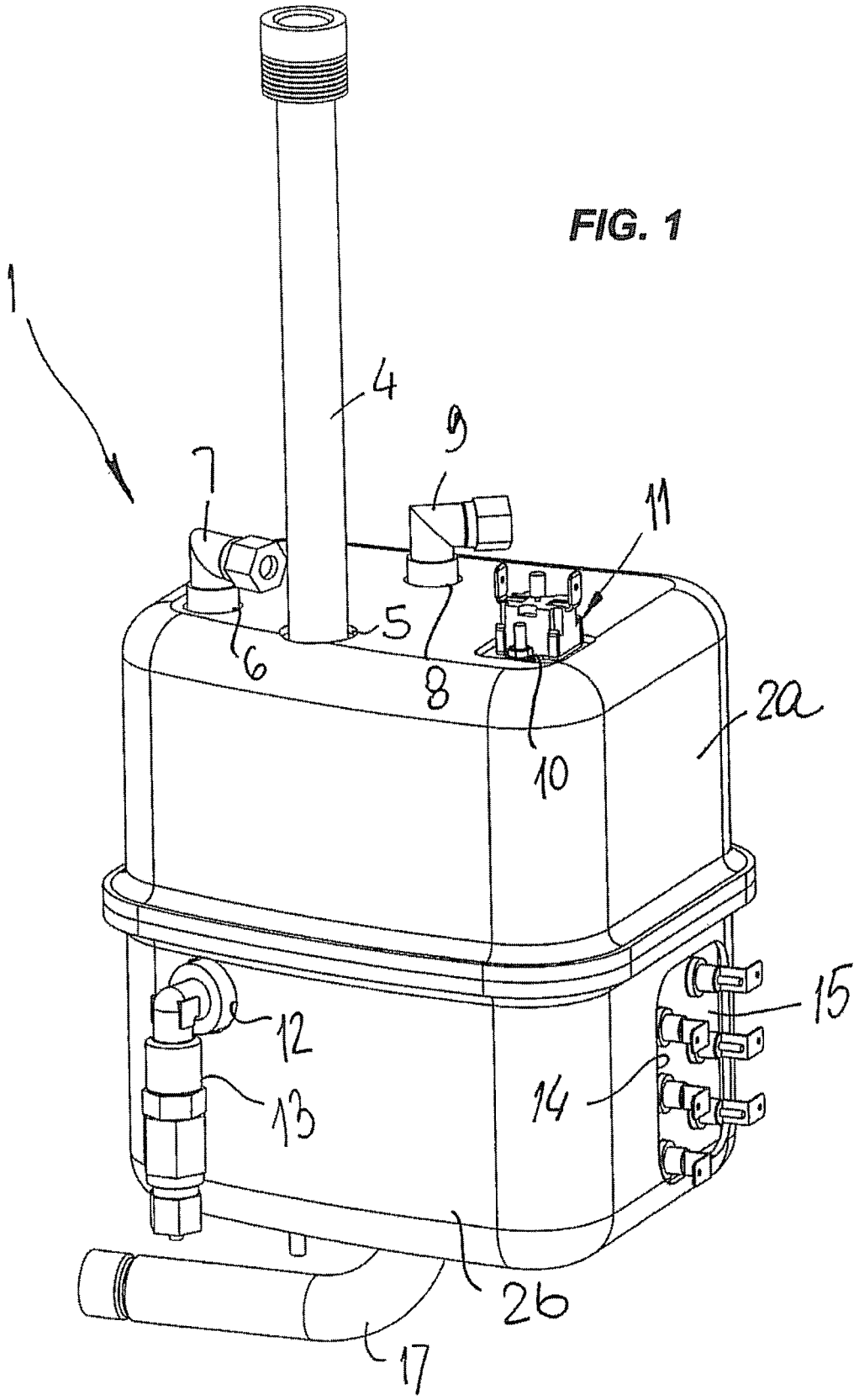
FIG. 1 is a perspective view of a boiler for domestic appliances with steam production, according to the invention.

Referring to the accompanying figures, numeral 1 generally designates a boiler for domestic appliances and water heating systems with steam production for home and industrial use.

The boiler 1 comprises a box-like container body, which is composed of upper and lower half-shells 2*a*, 2*b*, stably joined together by joining means, e.g. by welding, and defining therein a fluid-tight heating chamber 3, which is designed to contain a liquid to be heated and vaporized, namely water.

The box-like body of the boiler 1 is equipped with a plurality of apertures that are designed to receive elements mounted thereto for operating a domestic appliance with steam production, namely a cleaning appliance, with the boiler 1 being adapted to be mounted thereto.

Namely, the upper half-shell 2*a* is formed with an aperture 5 for connection of a union 4 for filling the heating camber 3 with a predetermined volume of water or introducing a water level probe, an aperture 6 for connection of a fitting 7 which is designed to be connected to a steam control solenoid valve (not shown), an aperture 8 for connection of a second fitting 9 which is designed to be connected to a pressure safety valve (not shown), an aperture 10 for attachment of a temperature regulator 11 (not shown).

Figure 2:
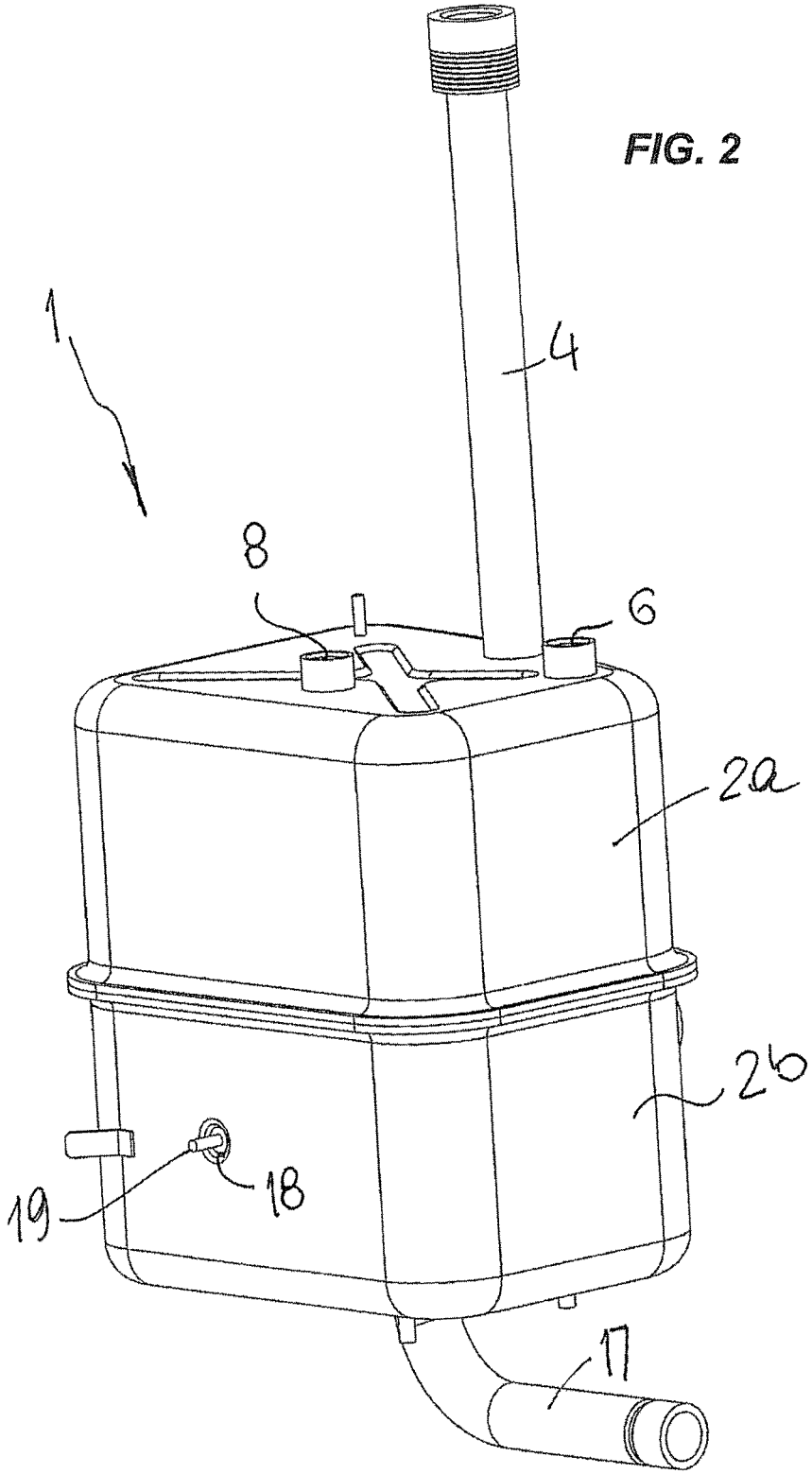
FIG. 2 is a perspective view of the boiler of FIG. 1, taken from a different angle.

The lower half-shell 2*b* is further formed with an aperture 12 for attachment of a fitting 13 which is designed for connection to a pipe (not shown) for continuous feed of filling water to the heating chamber 3, an aperture 14 for mounting a terminal block 15 with the contacts for electric connection of a series of heatable resistors as described in greater detail below, an aperture 16 (see FIGS. 2 and 3) for connection of a drainage pipe 17, which may be also used for bleeding heated water, and an aperture 18 for connection of a second temperature regulator 19.

Figure 3:
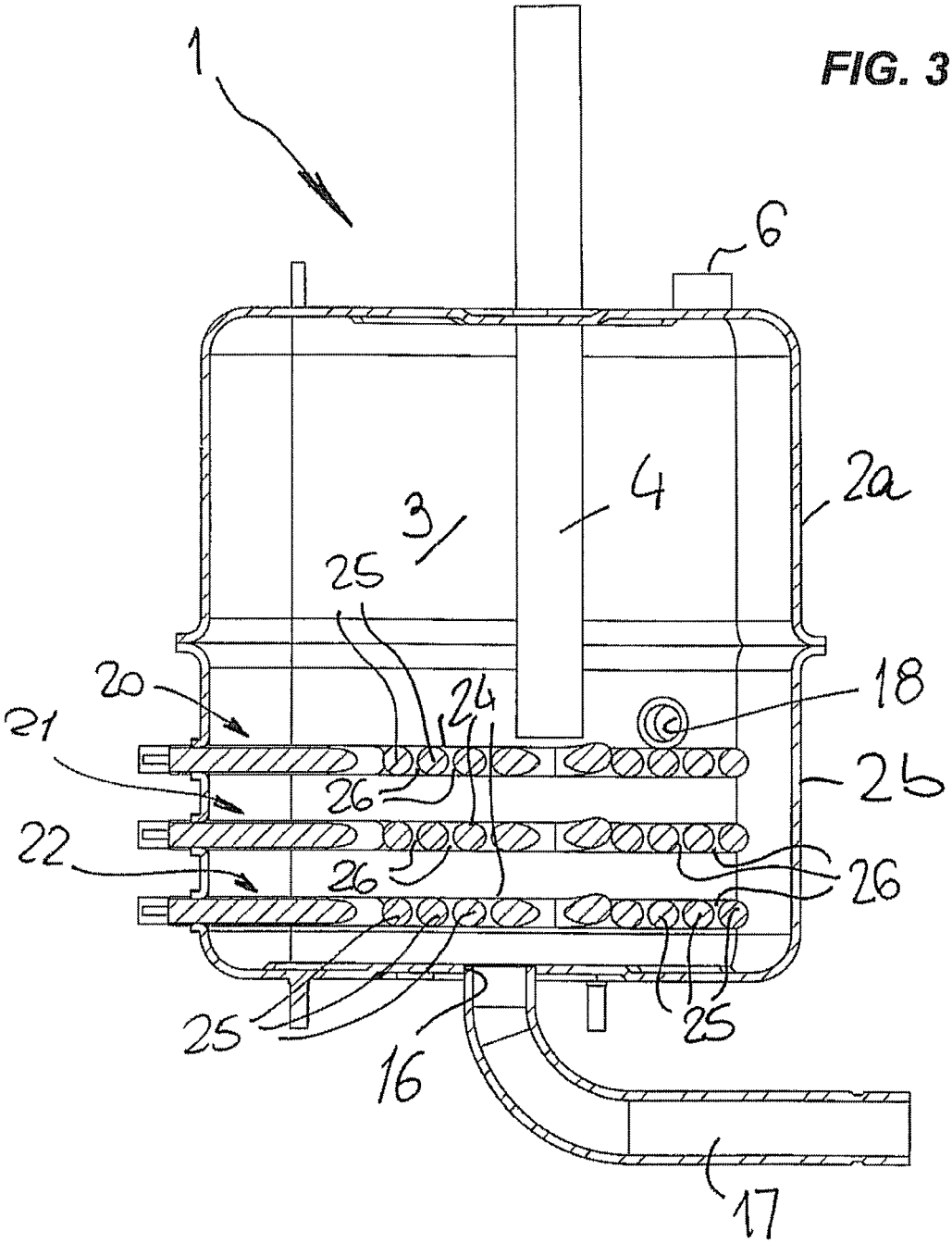
FIG. 3 is a cross sectional view of the boiler of FIG. 2, taken along an ideal plane that passes through its larger dimension and along its center line.
Figure 4:
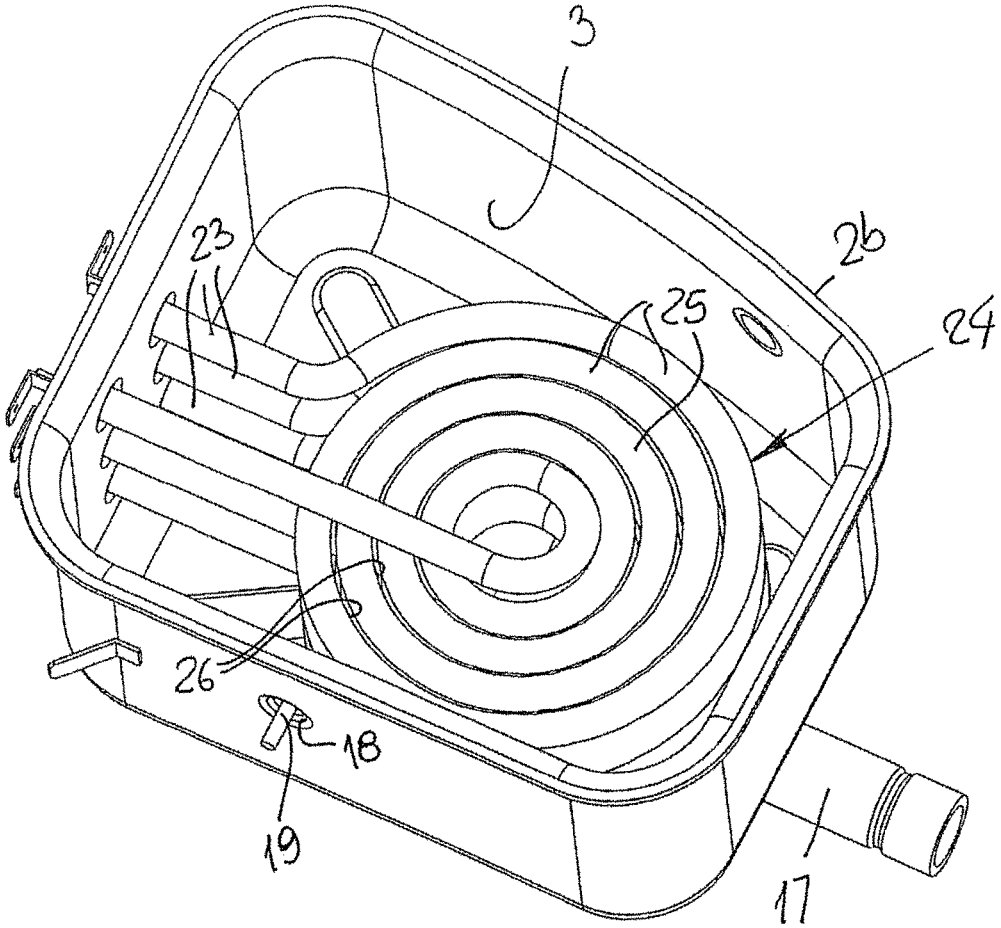
FIG. 4 is a perspective view of the interior of the boiler of FIG. 2, with an upper portion being removed, for clearer vision.

Referring to FIGS. 3 and 4, it shall be noted that the heating chamber 3 houses three identical electric resistors, referenced 20, 21, 22 respectively, and having respective terminals for connection to power cords, which are associated to the terminal block 15 and projecting outwards.

Each of the resistors 20, 21, 22 consists of an elongate heatable member 23, which is coiled into a flat spiral 24.

The three flat spirals 24 are arranged in parallel and spaced relationship in the heating chamber 3, preferably in a portion therein, defined by the lower half-shell 2*b*.

As shown in FIGS. 1 to 4, spaces are defined between contiguous turns 25 of each spiral 20, 21, 22 through which the water in the heating chamber 3 may freely flow to lap the entire radiant surfaces of the three resistors 20, 21, 22.

Still referring to FIGS. 1 to 4, it shall be noted that the three resistors 20, 21, 22 are arranged one on top of the other, to allow spontaneous generation of hot water flows from the bottom resistor 22 to those overlying it 21 and 20.

Thus, the water heated by the bottom resistor 22 flows to the intermediate resistor 21, where it receives additional heating and then to the top resistor 20, where heating further increases to the evaporation temperature.

Therefore, once a water evaporation temperature is set to be reached in the heating chamber 3, the bottom resistor 22 provides the largest amount of heating energy, like in a prior art boiler, whereas the overlying resistors 21 and 20 provide an additional amount of thermal energy to attain the target temperature: each of these additional amounts is smaller than the amount provided by the bottom resistor 22, as the water flows that lap them are already considerably heated by such bottom resistor.

This additional thermal energy also affords considerable reduction of steam production times, to substantially achieve continuous operation.

The skilled person may also consider to reduce the total number of electric resistors to two units, or increase it above three units for each boiler, as shown in the figures by way of example.

It was generally found that the best efficiency results in terms of steam production rate and produced steam volume are obtained, irrespective of the number of resistors, i.e. two or more than two, placed in the heating chamber 3, when the ratio between the total radiant surface area of resistors and every liter of water to be heated, contained in the heating chamber 3, ranges from 45,000 $mm^2$ to 65,000 $mm^2$.

Particularly, an optimal value was found around 32,340 $mm^2$ of total radiant surface area per liter of water to be heated, in other words 16,170 $mm^2$ per resistor if two resistors are provided, 10,780 $mm^2$ if three resistors are provided and other proportional values when there are more than three resistors, or different volumes of water to be heated.

Figure 5:
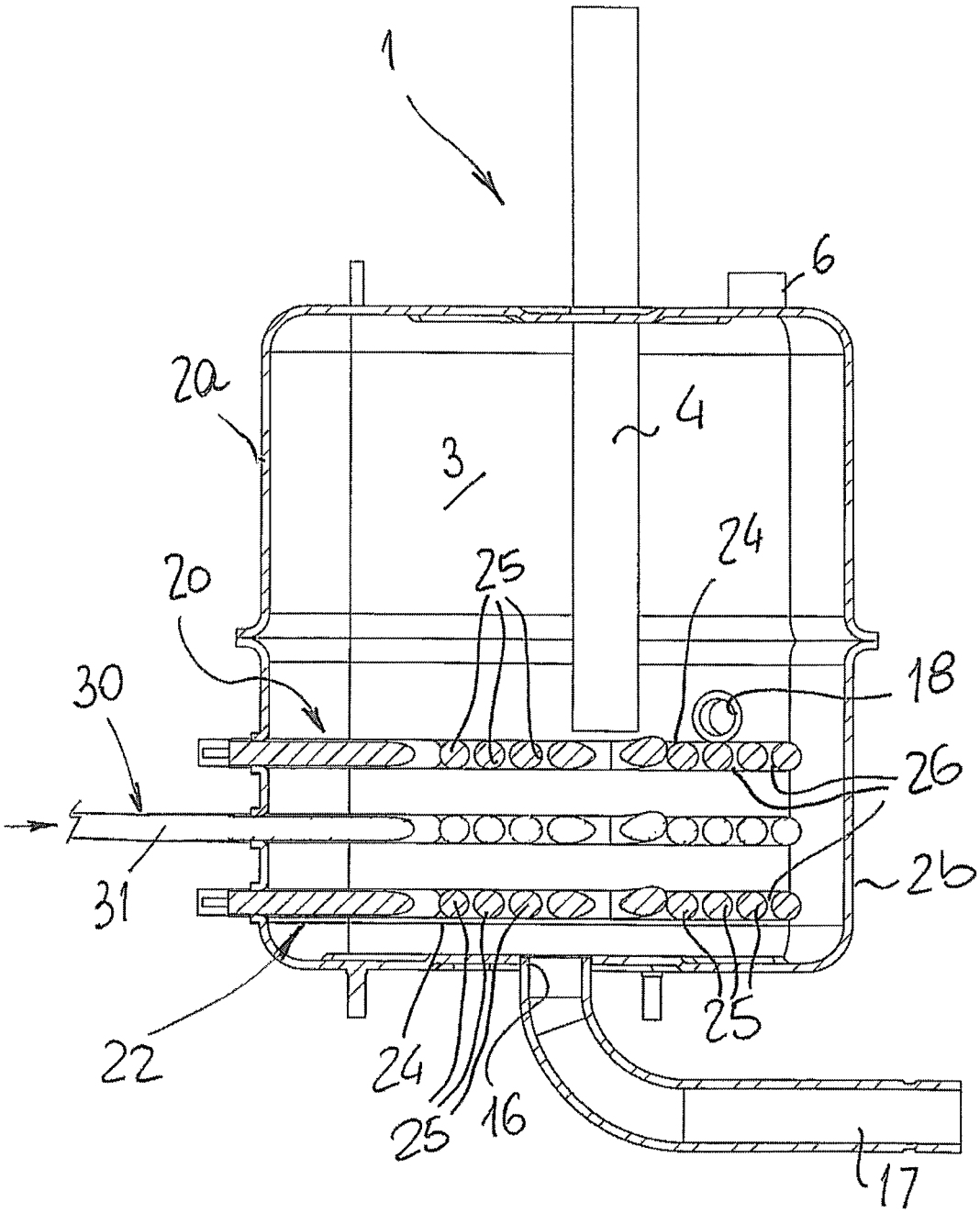
FIG. 5 is a cross-sectional view of a further embodiment of the boiler of the invention.
Figure 6:
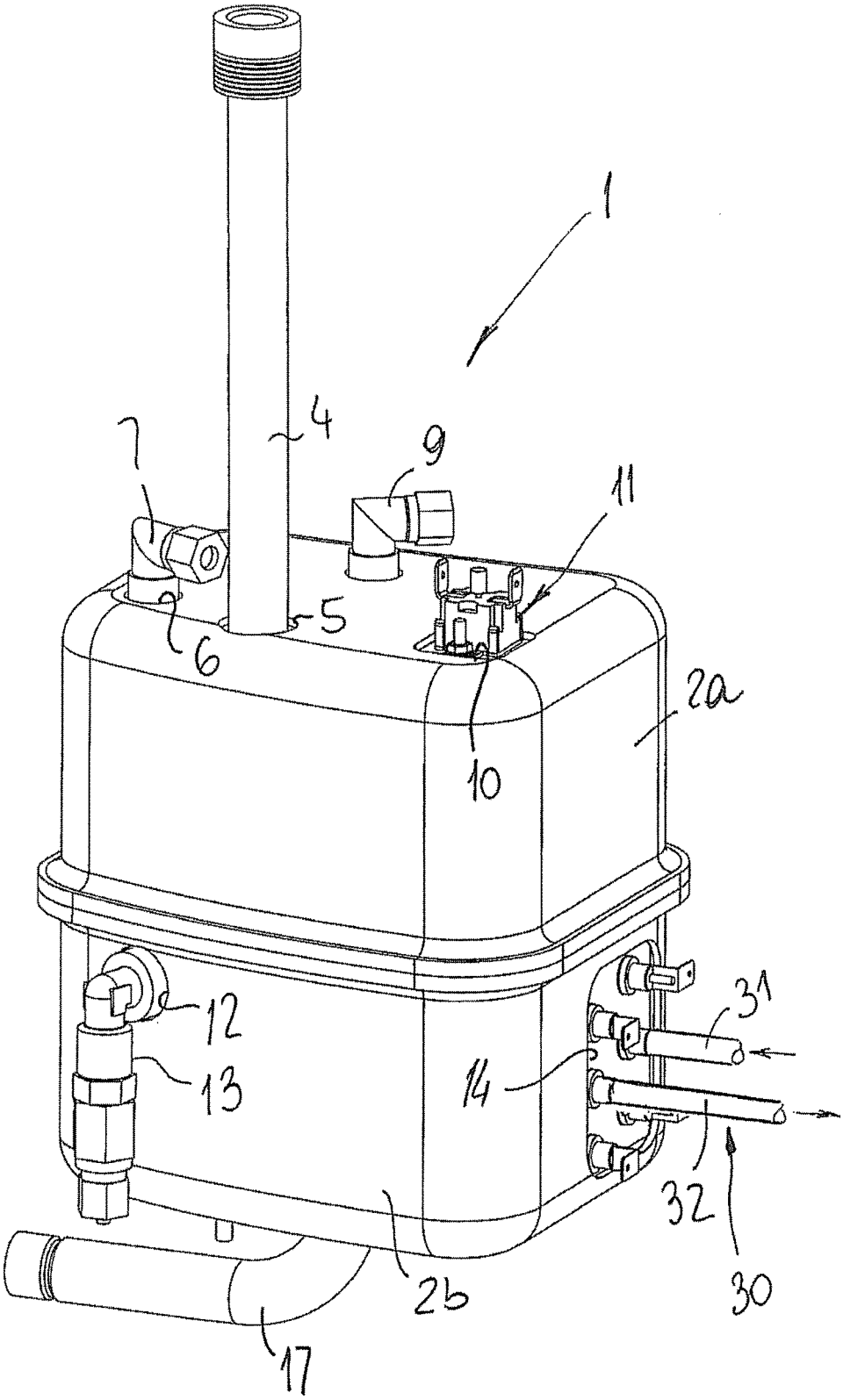
FIG. 6 is a perspective view of the boiler of FIG. 1, in the additional embodiment of FIG. 5.

Referring to the embodiment of the boiler 1 as shown in FIGS. 5 and 6, in which common elements are designated by the same reference numerals as those in FIGS. 1 to 4, the intermediate resistor 21 is found to be replaced by a pipe 30 in which an additional liquid to be heated, such as water or a cleansing or disinfection agent, is designed to flow at the same time as the two resistors 20 and 22 are switched on, which affords an optimized efficiency of the boiler 1, that can heat two liquids at the same time, or heat a liquid flowing in the pipe 30 while producing steam in the containment chamber 3.

As shown in detail in FIGS. 5 and 6, the pipe 30 has an inlet section 31 and an outlet section 32 and is also preferably formed into a spiral, like the resistors 20 and 22.

Figure 7:
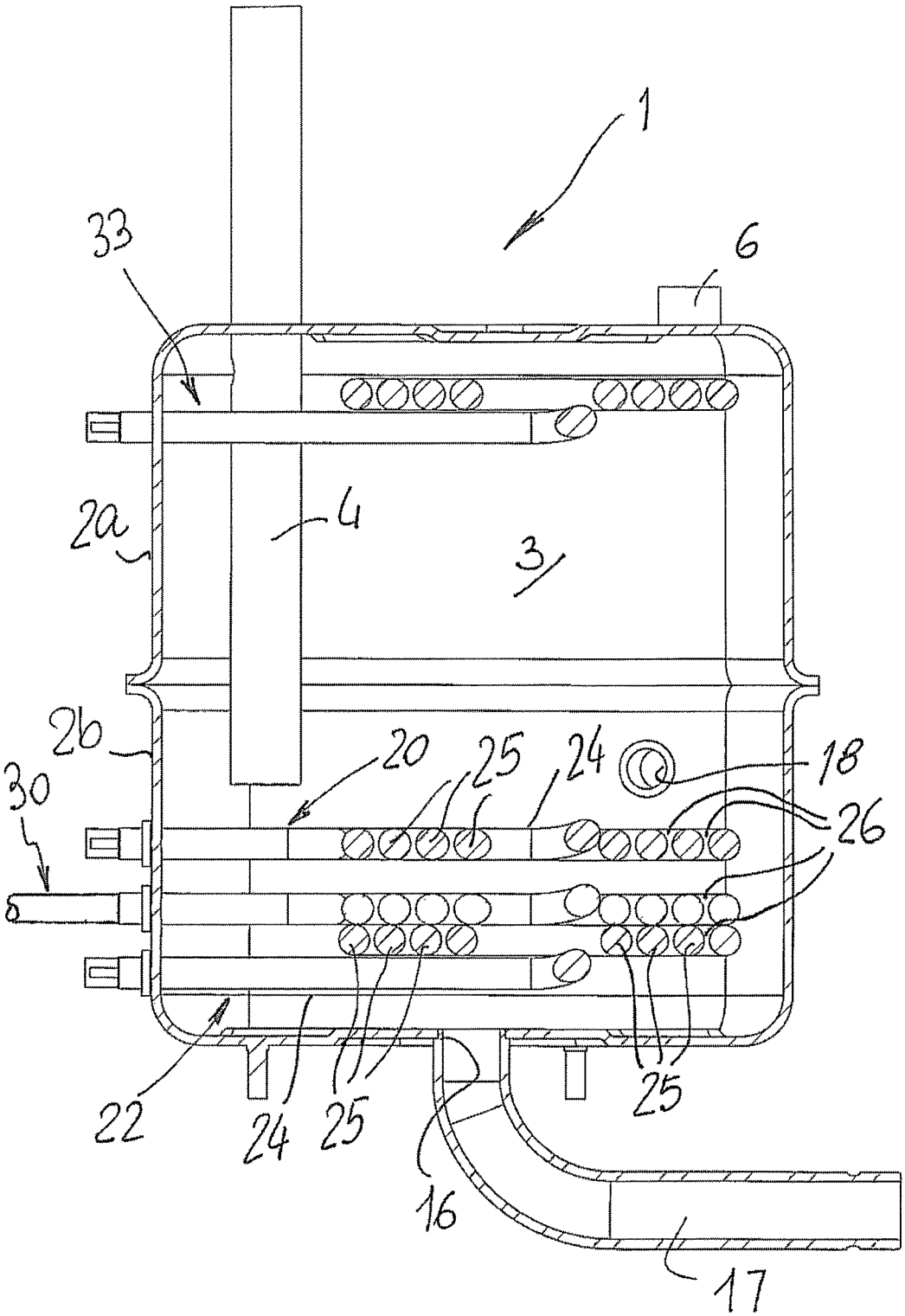
FIG. 7 is a cross sectional view of the boiler of FIG. 5, in which a different internal arrangement of resistors has been provided.

Referring to the embodiment of FIG. 7, the two spiral wound resistors 20 and 22 are shown to be mounted in the heating chamber 3.

A pipe 30 is again mounted therebetween, but here it lies in contact with one of the two resistors, namely the resistor 22.

Furthermore, an additional resistor 33 is mounted in the upper portion of the heating chamber 3 to allow, when needed, further heating of the steam generated in the heating chamber 3, before ejection of steam through the aperture 6.

This additional resistor 33 is also preferably wound into a spiral.

Figure 8:
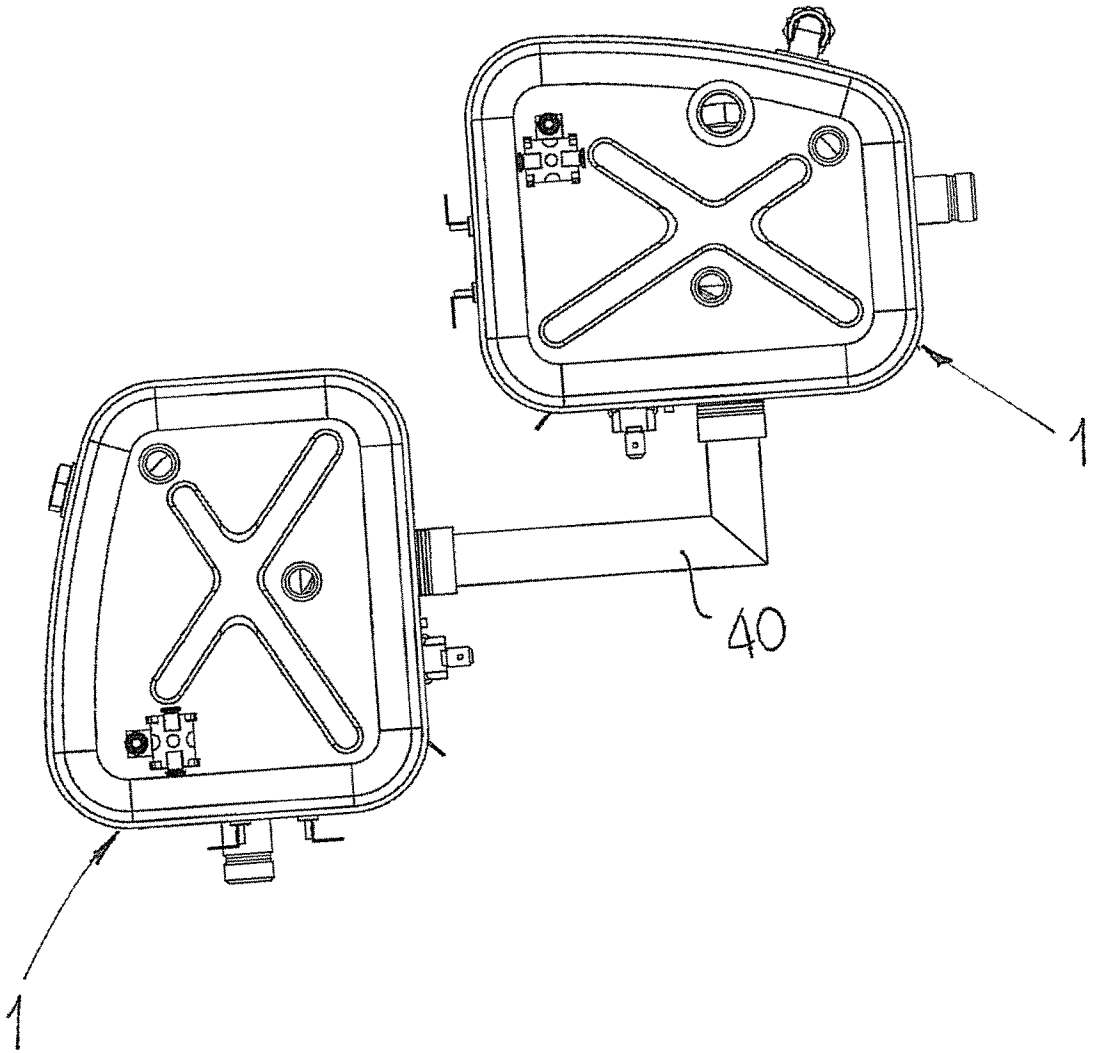
FIGS. 8, 9, 10 are top views of three possible connections of boilers for domestic appliances with steam production according to the invention, which can be integrated in a single appliance for industrially multiplying or reducing the overall steam force or the volumes of hot water that can be produced.
Figure 9:
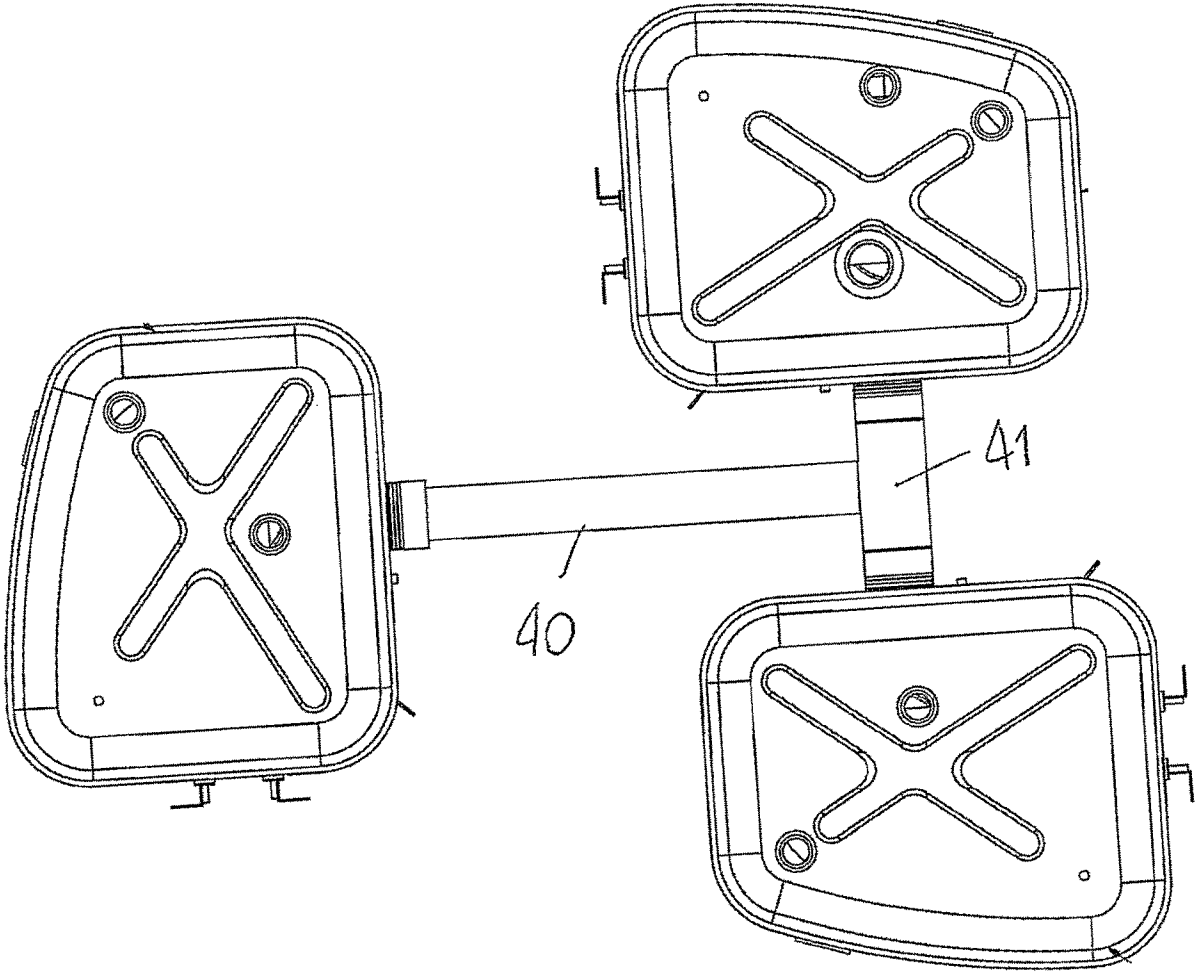
Figure 10:
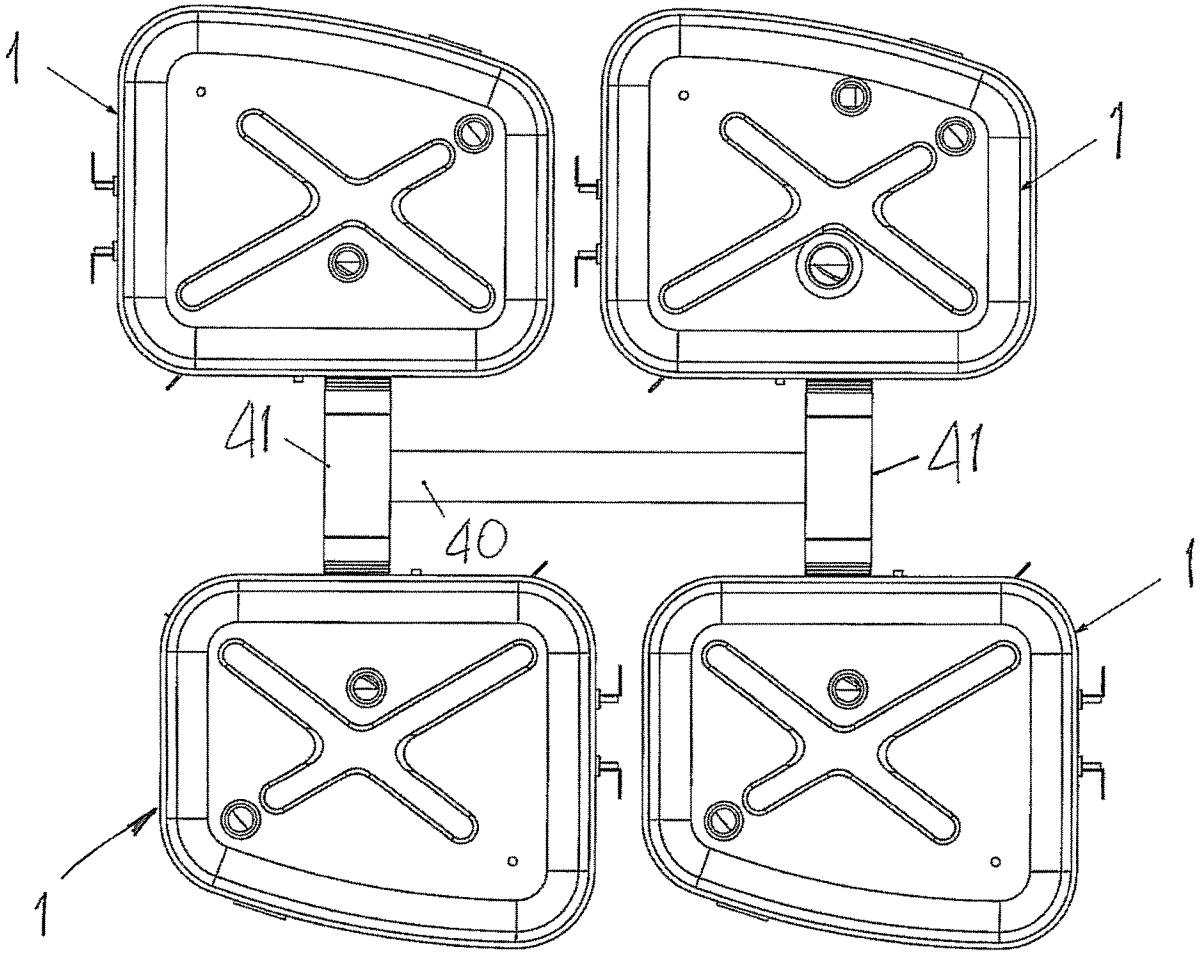

Referring to FIGS. 8 to 10, the boiler 1 is shown to be coupled to additional identical boilers 1 by means of link pipes 40 and 41, which join together their box-like bodies and allow transfer of hot water or steam, or adjustment of the overall power of a domestic appliance with steam production, as needed.

The operation of the boiler of the invention, when it is mounted in a domestic appliance with steam production, is substantially identical to the operation of a prior art boiler, and only essentially differs therefrom in that a convective flow of hot water is created between the resistors 20, 21 and 22, said water being heated first by the bottom resistor 22, then by the intermediate resistor 21 and finally by the top resistor 20.

The convective flows are facilitated in their movement through the turns 25 of the resistors 20, 21, 22 by the spaces 25 which allow water to lap the entire radiant surfaces.

This, the water to be heated receives a first amount of thermal energy by the bottom resistor 22 thereby being subjected to a first heating.

Then, it migrates toward the intermediate resistor 21, where it receives a second amount of thermal energy, which further increases its temperature.

Finally, it reaches the top resistor 20, which provides a final amount of thermal energy, causing steam production in the heating chamber 3 of the boiler 1.

The convective motion of water is substantially constant even when steam emission is required while additional low-temperature filling water is introduced into the heating chamber.

Such filling water immediately mixes with the convective flows of the residual hot water contained in the heating chamber 3, thereby causing almost instantaneous temperature increase, and becomes itself part of the convective heating motion.

Thus, a substantially constant steam production is obtained, with no waiting times being required for completing the heating cycles.

Referring to the embodiment of the boiler 1 as shown in FIGS. 5 and 6, the operation is shown to be substantially as described above, and to only differ therefrom in that, while liquid heating or steam generation may occur in the containment chamber 3, a second liquid to be heated may flow in the pipe 30, such liquid being heated by the heat supplied to generate steam in the containment chamber 3.

For instance, this second liquid may be a liquid cleansing or disinfection agent for a cleaning machine having the boiler 1 mounted thereto, such liquid being designed to be mixed with the steam generated in the heating chamber 3 such that, during mixing, a low temperature drop occurs and the cleaning jet that is used in the cleaning machine maintains a high temperature, that can dissolve any kind of dirt to be removed.

Referring to the embodiment as shown in FIG. 7, the operation is substantially the same as the above described embodiment of FIGS. 5 and 6.

It only differs therefrom in that the pipe 30 directly contacts the resistor 22 and receives therefrom a larger amount of thermal energy, thereby allowing quicker heating of the liquid flowing in this pipe 30.

Furthermore, in this embodiment, the additional resistor 33 mounted near the ceiling of the boiler 1, allows an additional amount of thermal energy to be supplied to the steam in the heating chamber 3, which is about to exit through the aperture 6.

It shall be further noted that the boiler of the invention can limit power consumption to the overall power required during use, by reducing the number of actuated resistors or switching them on all at the same time.

Furthermore, the total radiant surface areas of the resistors achieve a considerable decrease of the ratio of the power supplied to the heating surface areas, thereby protecting such surfaces and extending their life.

The invention was found to fulfill the intended objects.

The invention so conceived is susceptible to a number of changes and variants within the inventive concept.

Furthermore, all the details may be replaced by other technically equivalent parts.

In practical implementation, any materials, shapes and sizes may be used as needed, without departure from the scope of the following claims.

The invention claimed is:

1. A boiler (1) for households and water heating systems equipped with steam production for home and industrial use, comprising:

a container body (2*a*, 2*b*) configured to contain a liquid to be heated and vaporized, said containment body defining an inner heating chamber (3) having a containing volume and one inlet (5) of a liquid to be heated and vaporized and one outlet (6) of heated and/or vaporized liquid; and a heating device having a radiant heating surface;

wherein said heating device comprises at least a couple of radiant elements (20, 21) having respective radiant surfaces and fitted parallel and spaced reciprocally inside said heating chamber (3), said radiant elements being designed to be immersed in said liquid so as to create a convective flow of said liquid between said radiant surfaces, and wherein between said radiant elements (20, 21, 22) a passage duct (30) of an additive liquid to be heated is interposed, said passage duct (30) having one inlet and one outlet obtained in said container body (2*a*, 2*b*).

2. The boiler as claimed in claim 1, wherein each of said radiant surfaces comprises a linear body (23) which is spirally wound on a plane (23) and defines a plurality of coils (25), through which convective flow passages (26) of said liquid to be heated are defined.

3. The boiler as claimed in claim 1, wherein said radiant surfaces have a total radiant surface and said liquid to be heated and vaporized has a total volume, and wherein a ratio between said total radiant surface and said total volume is between 45,000 and 65,000 square millimeters for each liter of liquid to be heated and/or vaporized.

4. The boiler as claimed in claim 1, wherein said radiant elements (20, 21, 22) are identical.

5. The boiler according to claim 1, wherein said radiant elements (20, 21, 22) are superimposed.

6. The boiler according to claim 1, wherein each of said radiant surfaces comprises a linear body (23) which is spirally wound on a plane (23) and defines a plurality of coils (25), through which convective flow passages (26) of said liquid to be heated are defined, and wherein said passage duct (30) is shaped as a flat spiral substantially similar to said radiant elements (20, 21, 22).

7. The boiler according to claim 1, wherein said passage duct (30) is arranged adjacent to, or in contact with, at least one of said radiant elements (20, 21, 22).

8. The boiler according to claim 1, further comprising an additional radiant element (33) placed near to said outlet (6) of heated and/or vaporized liquid.

9. The boiler according to claim 8, wherein each of said radiant surfaces comprises a linear body (23) which is spirally wound on a plane (23) and defines a plurality of coils (25), through which convective flow passages (26) of said liquid to be heated are defined, and wherein said additional radiant element (33) is spirally wound on a plane.

10. The boiler according to claim 1, wherein said boiler is configured to be joined with further identical boilers (1) with coupling ducts (40, 41).

* * * * *